US007669264B1

(12) United States Patent
Moses

(10) Patent No.: US 7,669,264 B1
(45) Date of Patent: Mar. 2, 2010

(54) PATIENT TRANSPORT HARNESS AND ASSOCIATED METHOD

(76) Inventor: Christopher Moses, 1015 Woodlawn Ave., Linden, NJ (US) 07036

( * ) Notice: Subject to any disclaimer, the term of this patent is extended or adjusted under 35 U.S.C. 154(b) by 1 day.

(21) Appl. No.: 11/973,215

(22) Filed: Oct. 6, 2007

Related U.S. Application Data

(60) Provisional application No. 60/849,743, filed on Oct. 6, 2006.

(51) Int. Cl.
*A61G 1/01* (2006.01)

(52) U.S. Cl. ..... 5/628; 5/81.1 T; 5/627

(58) Field of Classification Search ..... 5/81.1 R, 5/81.1 T, 625–628; 128/875–876; 280/19
See application file for complete search history.

(56) References Cited

U.S. PATENT DOCUMENTS 5,720,303 A * 2/1998 Richardson ..... 128/870
5,978,989 A * 11/1999 Chavez ..... 5/627
6,851,145 B2 * 2/2005 Smith et al. ..... 5/627

* cited by examiner

*Primary Examiner*—Fredrick Conley

(57) ABSTRACT

A harness includes a single and unitary body with a plurality of longitudinal members and a plurality of latitudinal members monolithically formed therewith. The apparatus further includes a plurality of fasteners with opposed ends directly and oppositely mated to the longitudinal members and extending towards a center of the body for being engaged about the patient. Each of such fasteners has male and female members detachably and directly mated along a width of the body and between the longitudinal sides respectively. The apparatus further includes a first plurality of handles monolithically connected to the longitudinal members and extending laterally away therefrom along opposed sides of the body, and a second plurality of handles are monolithically connected to opposed corners of the body and diagonally protruding outwardly therefrom.

6 Claims, 1 Drawing Sheet

PATIENT TRANSPORT HARNESS AND ASSOCIATED METHOD

CROSS REFERENCE TO RELATED APPLICATIONS

This application claims the benefit of U.S. Provisional Application No. 60/849,743, filed Oct. 6, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to transport harnesses and, more particularly, to a patient transport harness for transporting a patient between remote locations during medical diagnostic testing procedures.

2. Prior Art

Ongoing research and new product development is an essential part of maintaining and improving health care afforded to the citizenry. This research and development is done on an international scale with many significant contributions being made by individuals. Whenever a new 'miracle drug' or technology is introduced into the medical field, the media's coverage ensures that the entire populace is informed. In actuality, the introduction of new drugs and new technologies is far less frequent than the continuing improvements to existing equipment and technologies, which also serve to advance the quality of medical services that can be afforded to the individual.

Medical staff frequently transfer patients from a bed to a gurney (and vice versa) for any number of reasons which includes taking the patient to get an X-ray, MRI exam, CT scan, and other reasons. Medical personnel must transfer the patient onto a table or platform when any of these diagnostic test procedures are required. The accomplishment of the transfer should be done without creating any pain, discomfort, or injury to the patient. Sometimes the transfer can be accomplished by only one person, but, frequently, more than one person is required to make the transfer as smoothly as possible. This has become increasingly true in recent years with the increasing number of patients who are overweight and obese. Having recognized the need for a patient transfer device which would be comfortable and secure for a patient and could accommodate a varying number of medical staff (from 1 to 8) to easily lift and transfer a patient, the present invention was developed. Based on the above mentioned needs, it would be advantageous to provide a means for facilitating the task of shifting a patient onto a bed, gurney, X-ray table, MRI platform or other device easily and safely.

U.S. Pat. No. 7,131,154 to Davis discloses a convertible wheeled chair that is easily changed by an attendant into a gurney of the same height as a patient bed. During the process of transferring a patient from an upright position to a reclining position, the convertible wheeled chair shifts the center of gravity of the patient rearwardly, and therefore does not give the patient a sensation of sliding from the chair. Unfortunately, this prior example does not assist in shifting a patient from one bed or platform to another.

U.S. Pat. No. 6,728,979 to Robert discloses a device for transferring medical patients from one table, bed, or gurney to another. The device includes a slide board which is slid beneath the patient while the patient is on the gurney. The slide board is then connected to a winch which rests on a cart and can be activated in a controlled manner. The action of the winch pulling the slide board in a horizontal fashion makes the transfer of the patient simple and easy. The cart is designed to be mobile, but includes hooks for fixing the cart to the floor so that it may withstand the stress induced by the retraction of the winch cable. Unfortunately, this prior art example cannot be used to carry a patient from place to place.

U.S. Pat. No. 6,701,546 to Hodgetts discloses a wheelchair convertible into a gurney that includes a main frame, a rear frame and a supplemental rear frame pivotally secured to the rear frame. The main frame includes a back portion pivotally secured to a seat portion which is pivotally secured to a leg portion. The rear frame is pivotally secured to the back portion. A guide arrangement is provided that contacts with the supplemental rear frame and the main frame whereby the main frame is in a first position. The back portion, seat portion and leg portion are arranged so that they are in different planes and when the main frame is in a second position, the back portion, seat portion and leg portion are arranged so that they are in a gurney position. Unfortunately, this prior example does not assist in shifting a patient from one bed or platform to another.

Accordingly, the present is disclosed in order to overcome the above noted shortcomings. The present invention satisfies such a need by providing an apparatus that is convenient and easy to use, lightweight yet durable in design, and designed for transporting a patient between remote locations during medical diagnostic testing procedures. The patient transport harness is simple to use, inexpensive, and designed for many years of repeated use.

BRIEF SUMMARY OF THE INVENTION

In view of the foregoing background, it is therefore an object of the present invention to provide an apparatus for transporting a patient between remote locations during medical diagnostic testing procedures. These and other objects, features, and advantages of the invention are provided by a patient transport harness.

A harness includes a single and unitary body with a plurality of longitudinal members and a plurality of latitudinal members monolithically formed therewith respectively. Such a body further has a plurality of cavities effectively formed between the longitudinal and lateral members respectively, and also has a substantially rectangular shape. The body includes a head section formed at a proximal end thereof and is formed from flexible non-magnetic material and resiliently adapted between a tubular rolled position and a planar flat position. Such a head section includes a pair of coextensively shaped orifices equidistantly offset from a center thereof. Such a center has a solid surface onto which a head of the patient is supported during transport, and such a solid surface spans between two proximally seated latitudinal members wherein the orifices extend distally from a proximal end of the head section and conveniently terminate prior to reaching a first one of the cavities. Such latitudinal members maintain direct contact against a patient laid on the body and further create a resistive force against posterior movement of the patient between the longitudinal sides.

The apparatus further includes a plurality of fasteners with opposed ends directly and oppositely mated to the longitudinal members and extending towards a center of the body for being engaged about the patient. Each of such fasteners has male and female members advantageously detachably and directly mated along a width of the body and between the longitudinal sides respectively. The fasteners further extend upwardly along an anterior side of the body.

The apparatus further includes a first plurality of handles monolithically connected to the longitudinal members and extending laterally away therefrom along opposed sides of the body, and a second plurality of handles are monolithically connected to opposed corners of the body and diagonally protruding outwardly therefrom. Such first and second pluralities of handles are effectively coplanar with the body, and further are covered with a rubber sleeve for providing a frictional surface onto which a caregiver grips the handles during transport. Such rubber sleeves extend along a major circumference of the first and second pluralities of handles.

A method for transporting a patient between remote locations during medical diagnostic testing procedures includes the steps of: providing a single and unitary body with a plurality of longitudinal members and a plurality of latitudinal members monolithically formed therewith respectively, the body further having a plurality of cavities formed between the longitudinal and lateral members respectively; providing a plurality of fasteners with opposed ends directly and oppositely mated to the longitudinal members and extending towards a center of the body for being engaged about the patient; providing a first plurality of handles monolithically connected to the longitudinal members and extending laterally away therefrom along opposed sides of the body; providing a second plurality of handles monolithically connected to opposed corners of the body and diagonally protruding outwardly therefrom; and resiliently adapting the body between a tubular rolled position and a planar flat position during non-transport and transport procedures.

The method further includes the steps of: a caregiver gripping the handles and lifting the patient above a ground surface; and placing a patient head on a head section formed at a proximal end of the body such that the patient head spans between two proximally seated latitudinal members and becomes medially disposed between the orifices extending distally from a proximal end of the head section.

The method further includes the steps of: detachably and directly mating male and female members of each of the fasteners along a width of the body and between the longitudinal sides respectively; and maintaining direct contact against a patient and the latitudinal members and thereby creating a resistive force against posterior movement of the patient between the longitudinal sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
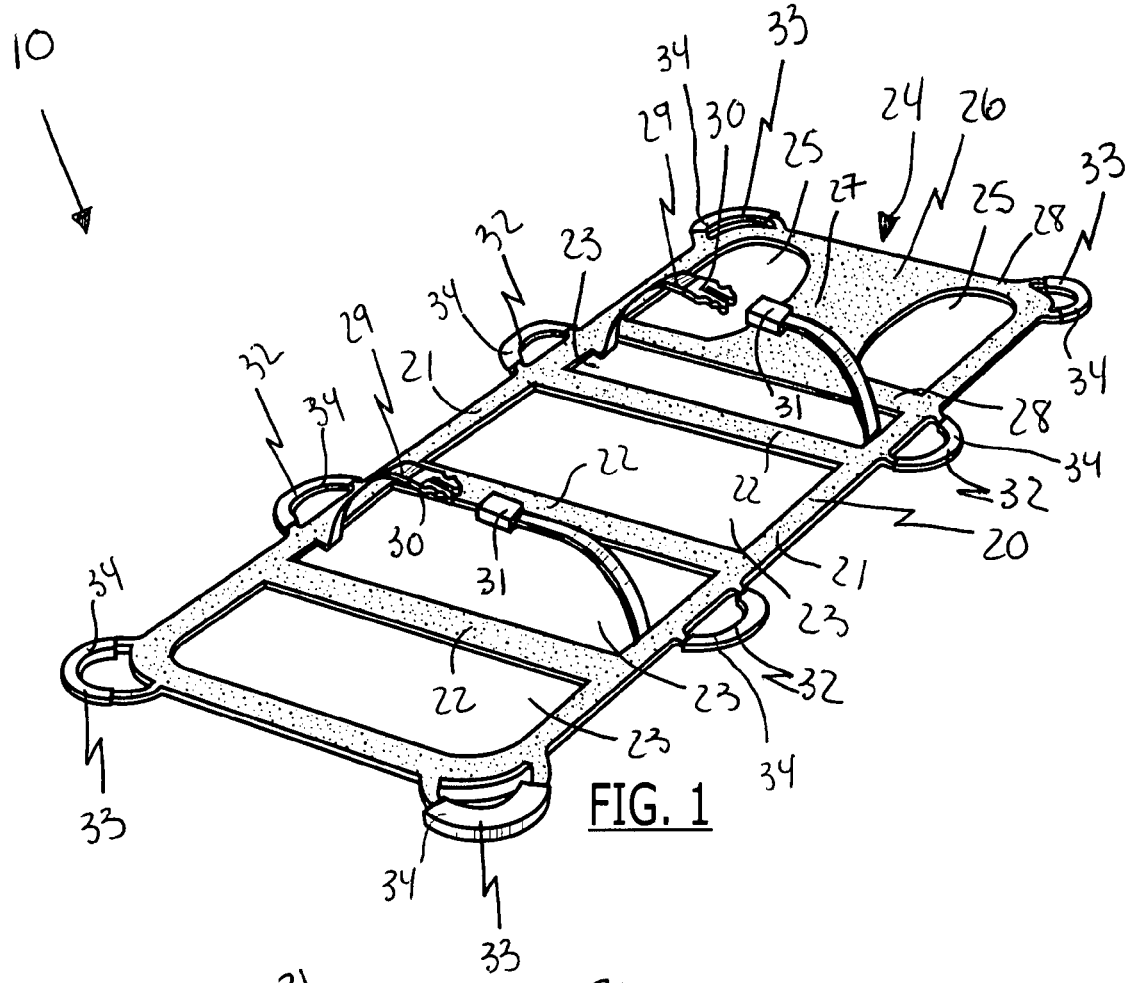
FIG. 1 is a perspective view showing a patient transport harness in a planar flat position, in accordance with the present invention.
Figure 2:
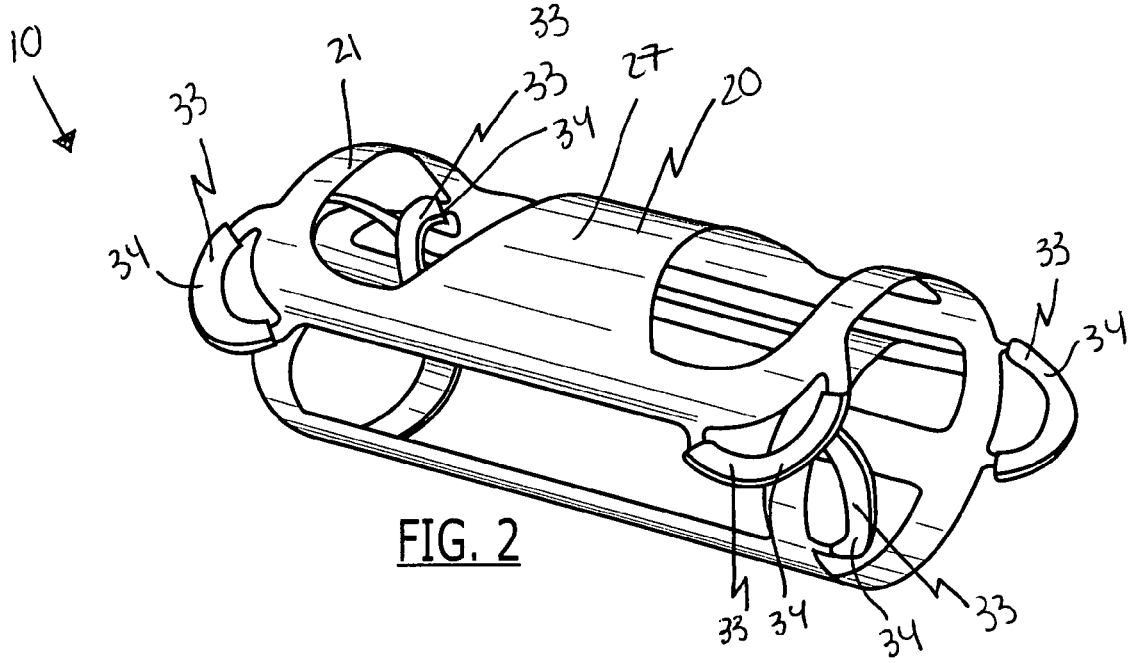
FIG. 2 is a patient transport harness in a tubular rolled position, in accordance with the present invention.

The apparatus of this invention is referred to generally in FIGS. 1-2 by the reference numeral 10 and is intended to protect a patient transport harness. It should be understood that the apparatus 10 may be used to protect many different people and should not be limited to only those types of people mentioned herein.

Referring initially to FIGS. 1 and 2, a harness 10 includes a single and unitary body 20 with a plurality of longitudinal members 21 and a plurality of latitudinal members 22 monolithically formed therewith respectively. Such a body 20 further has a plurality of cavities 23 formed between the longitudinal and lateral members 21, 22 respectively, and also has a substantially rectangular shape. The body 20 includes a head section 24 formed at a proximal end thereof and is formed from flexible non-magnetic material and resiliently adapted between a tubular rolled position and a planar flat position. Such a head section 24 includes a pair of coextensively shaped orifices 25 equidistantly offset from a center 26 thereof.

Such a center 26 has a solid surface 27 onto which a head of the patient is supported during transport, and such a solid surface 27 spans between two proximally seated latitudinal members 28 wherein the orifices 25 extend distally from a proximal end of the head section 24 and terminate prior to reaching a first one of the cavities 23. Such latitudinal members 28 maintain direct contact against a patient laid on the body 20 and further create a resistive force against posterior movement of the patient between the longitudinal sides 21. The head section 24 supports a user head during transport procedures in order to ensure maximum comfort and safety.

Referring again to FIGS. 1 and 2, the apparatus 10 further includes a plurality of fasteners 29 with opposed ends directly and oppositely mated, without the use of intervening elements, to the longitudinal members 21 and extending towards a center of the body 20 for being engaged about the patient.

Each of such fasteners 29 has male and female members 30, 31 detachably and directly mated, without the use of intervening elements, along a width of the body 20 and between the longitudinal sides respectively. The fasteners 29 further extend upwardly along an anterior side of the body 20. The fasteners 29 ensure that a user remains firmly secured to the body 20, thereby minimizing accidents during transportation.

Referring again to FIGS. 1 and 2, the apparatus 10 further includes a first plurality of handles 32 monolithically connected to the longitudinal members 21 and extending laterally away therefrom along opposed sides of the body, and a second plurality of handles 33 are monolithically connected to opposed corners of the body 20 and diagonally protruding outwardly therefrom. Such first and second pluralities of handles 32, 33 are coplanar with the body 20, and further are covered with a rubber sleeve 34 for providing a frictional surface onto which a caregiver grips the handles 32 during transport. Such rubber sleeves 34 extend along a major circumference of the first and second pluralities of handles 32, 33. The first and second pluralities of handles 32, 33 enable a plurality of persons to carry the body and patient as needed.

The patient transport harness includes a rectangular, plastic frame and sturdy nylon straps. Of course, such a frame and straps can be produced from a variety of suitable materials, and in a variety of sizes, as is obvious to a person of obvious skill in the art. Such a frame is rectangular in shape and features conveniently curved hand grips that are used for effectively lifting the apparatus with a patient therein, when a patient is to be transferred. The frame includes a plurality of hand grips that are advantageously positioned one at each corner and two on each side, which is essential for allowing the apparatus, with a patient therein, to be easily and safely transferred to another location. Such a plurality of hand grips are enclosed in a soft rubber material to afford comfort for personnel when using the device. Of course, the plurality of handles can be produced in a variety of suitably soft materials, as is obvious to a person of ordinary skill in the art.

Sturdy, nylon, web type straps are directly connected to the sides of the frame, without the use of intervening elements, at positions that effectively correspond with the location of the shoulders, upper back, pelvis, and knees of the human body, which is crucial for effectively securing a patient to the device prior to transfer. The apparatus includes a plurality of adjustable securing straps that are strapped across a patient while the patient is being transferred. Such a plurality of straps is conveniently equipped with plastic buckles, and is secured over the chest and thighs of a patient. Of course, such buckles can be produced in a variety of suitable materials, as is obvious to a person of ordinary skill in the art.

The present invention, as claimed, provides the unexpected and unpredictable benefit of an apparatus that is convenient and easy to use, lightweight yet durable in design, and makes it possible for medical staff to efficiently move and transfer a patient without any undue movement, repositioning, or discomfort for the patient. Such a transfer is accomplished by one individual without any assistance being required, or by up to eight individuals, as required. The present invention is an innovative and practical patient transfer apparatus that can be advantageously used by medical staff to transfer a patient efficiently and without sacrificing safety. The apparatus can also be advantageously used by fire departments and EMTs for transferring individuals in emergency situations.

In use, a method for transporting a patient between remote locations during medical diagnostic testing procedures includes the steps of: providing a single and unitary body 20 with a plurality of longitudinal members 21 and a plurality of latitudinal members 22 monolithically formed therewith respectively, the body 20 further having a plurality of cavities 23 formed between the longitudinal and lateral members 21, 22 respectively; providing a plurality of fasteners 29 with opposed ends directly and oppositely mated, without the use of intervening elements, to the longitudinal members 21 and extending towards a center of the body 20 for being engaged about the patient; providing a first plurality of handles 32 monolithically connected to the longitudinal members 21 and extending laterally away therefrom along opposed sides of the body 20; providing a second plurality of handles 33 monolithically connected to opposed corners of the body 20 and diagonally protruding outwardly therefrom; and resiliently adapting the body 20 between a tubular rolled position and a planar flat position during non-transport and transport procedures.

In use, the method further includes the steps of: a caregiver gripping the handles 32, 33 and lifting the patient above a ground surface; and placing a patient head on a head section 24 formed at a proximal end of the body 20 such that the patient head spans between two proximally seated latitudinal members 28 and becomes medially disposed between the orifices 25 extending distally from a proximal end of the head section 24.

In use, the method further includes the steps of: detachably and directly mating, without the use of intervening elements, male and female members 30, 31 of each of the fasteners 29 along a width of the body 20 and between the longitudinal sides 21 respectively; and maintaining direct contact against a patient and the latitudinal members 22 and thereby creating a resistive force against posterior movement of the patient between the longitudinal sides 21.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A harness for transporting a patient between remote locations during medical diagnostic testing procedures, said harness comprising:

a single and unitary body having a plurality of longitudinal members and a plurality of latitudinal members monolithically formed therewith respectively, said body further having a plurality of cavities formed between said longitudinal and lateral members respectively, said body having a substantially rectangular shape;

a plurality of fasteners having opposed ends directly and oppositely mated to said longitudinal members and extending towards a center of said body for being engaged about the patient;

a first plurality of handles monolithically connected to said longitudinal members and extending laterally away therefrom along opposed sides of said body; and a second plurality of handles monolithically connected to opposed corners of said body and diagonally protruding outwardly therefrom;

wherein said first and second pluralities of handles are coplanar with said body;

wherein said body is formed from flexible non-magnetic material and resiliently adapted between a tubular rolled position and a planar flat position;

wherein said longitudinal and latitudinal members are oriented in a non-overlapping pattern such that said longitudinal members are integrally formed with opposed ends of said latitudinal members respectively.

2. The harness of claim 1, wherein said each of said first and second pluralities of handles are covered with a rubber sleeve for providing a frictional surface onto which a caregiver grips said handles during transport, said rubber sleeves extending along a major circumference of said first and second pluralities of handles.

3. The harness of claim 1, wherein said body comprises: a head section formed at a proximal end thereof, said head section including a pair of coextensively shaped orifices equidistantly offset from a center thereof, said center having a solid surface onto which a head of the patient is supported during transport, said solid surface spanning between two proximally seated latitudinal members wherein said orifices extending distally from a proximal end of said head section and terminate prior to reaching a first one of said cavities.

4. The harness of claim 1, wherein each of said fasteners have male and female members detachably and directly mated along a width of said body and between said longitudinal sides respectively.

5. The harness of claim 1, wherein said fasteners extending upwardly along an anterior side of said body.

6. The harness of claim 1, wherein said latitudinal members maintain direct contact against a patient laid on said body and further create a resistive force against posterior movement of the patient between said longitudinal sides.

* * * * *